United States Patent [19]

Olson

[11] 4,141,516

[45] Feb. 27, 1979

[54] DISPENSER FOR SHEET MATERIAL

[75] Inventor: Stephen R. Olson, Sioux City, Iowa

[73] Assignee: Iowa Beef Processors, Inc., Dakota City, Nebr.

[21] Appl. No.: 802,336

[22] Filed: Jun. 1, 1977

[51] Int. Cl.[2] ..... A47K 10/22; A47K 10/34

[52] U.S. Cl. ..... 242/55.53; 226/129; 242/68.7; 242/75.4; 312/39

[58] Field of Search ..... 242/55.53, 55.3, 68.7, 242/55.2, 55, 75.4; 226/129, 130, 134, 136, 132, 133, 135, 131, 139, 141, 142; 312/38, 39; 225/46, 39, 51, 77, 79

[56] References Cited

U.S. PATENT DOCUMENTS

| | | | |
|---|---|---|---|
| 2,946,587 | 7/1960 | Ryno | 226/130 |
| 2,973,958 | 3/1961 | Casey et al. | 226/130 |
| 3,672,552 | 6/1972 | Krueger et al. | 226/129 |

*Primary Examiner*—George F. Mautz

*Attorney, Agent, or Firm*—Beveridge, DeGrandi, Kline & Lunsford

[57] ABSTRACT

A roll of sheet material is supported on two spaced apart support rollers. During each dispensing cycle, the angular displacement of one of the support rollers is limited by a mechanism which includes a rotary member and a pivoted member. The rotary member carries a projection and is driven in an amount proportional to the amount of support roller movement. The pivoted member has an abutment surface and a reset surface. The abutment surface and the reset surface are positioned so the projection approaching the pivoted member contacts the abutment surface before coming to the reset surface. The abutment surface lies in the path of the projection to stop rotation of the rotary member and thus stop dispensation of the sheet material. A handle moves the pivoted member to withdraw the abutment from the projection path and to move the reset surface into the projection path. Movement of the projection against the reset surface moves the pivoted member to bring the handle over-center and return the abutment surface to its projection-abutting position where it will stop the movement of the rotary member upon completion of one revolution. This stops dispensation of sheet material until the handle is operated again to withdraw the abutment from the projection path.

12 Claims, 7 Drawing Figures

FIG.3
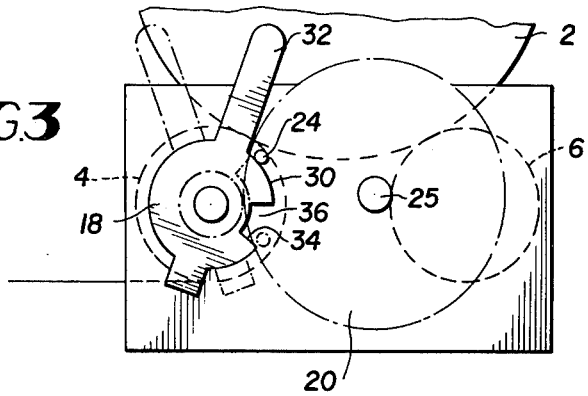
FIG.4
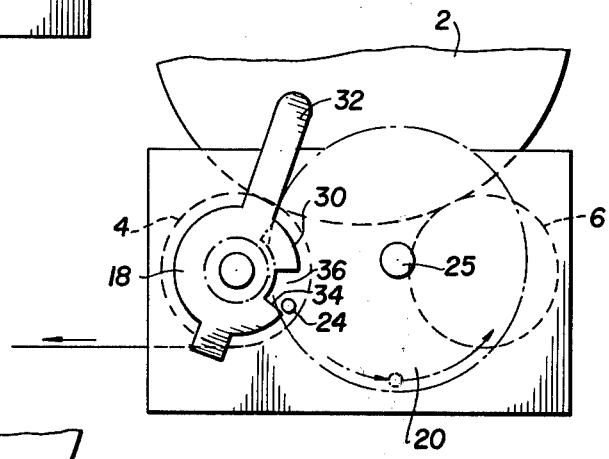
FIG.5
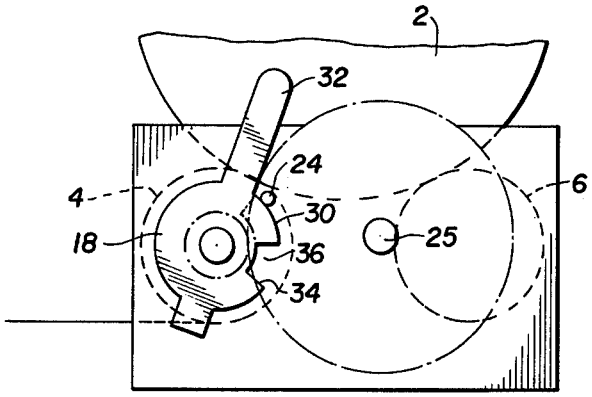
FIG.6
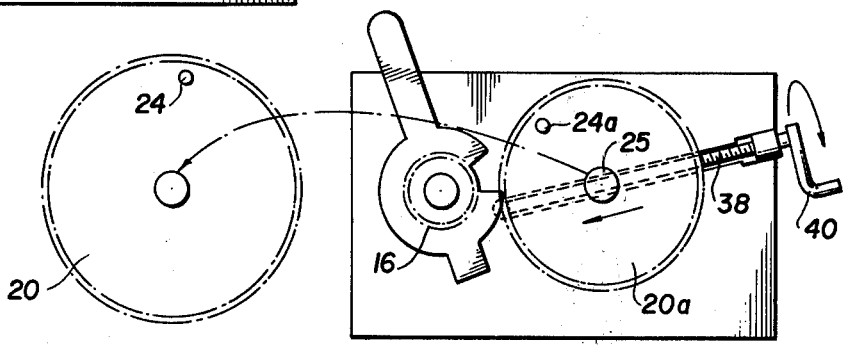
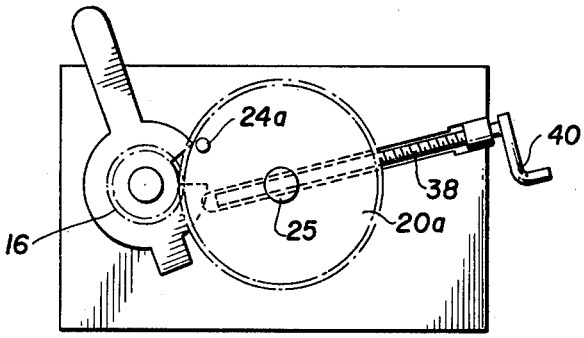
FIG.7

DISPENSER FOR SHEET MATERIAL

BACKGROUND AND SUMMARY OF THE INVENTION

This invention relates to apparatus for dispensing uniform lengths of sheet material from a roll. The invention is especially well-suited to the dispensation of a sheet boneguard material used as a protective meat-packaging sheet placed between bones and external packaging materials.

There are many measuring dispensers capable of dispensing uniform lengths of toweling and other sheet materials. In some instances, the roll of sheet material is supported by a pair of support rollers, the angular movement of one such roller being limited to permit the release of a precise and uniform length of material. Various other dispensers limit the angular rotation of so-called measuring rollers to govern the length of material dispensed. However, in these systems, the mechanisms for stopping and releasing the measuring rollers has been rather complex, often involving ratchet mechanisms, floating cams, timing mechanisms, crank-operated slides or other components with a large number of moving parts which renders them inherently susceptible to malfunction. Although these prior devices presumably perform satisfactorily for many purposes, it is believed that the present invention involves a significant simplification in measuring dispensers for sheet material.

The apparatus disclosed herein has many desirable features as the roll of sheet material is easily loaded into and unloaded from the dispenser without moving or removing any mechanical elements of the device. The device is easily threaded as the sheet material must be led around only a single roller. Rolls of sheet material having a wide diversity of widths may be accompanied on the single apparatus without adjustment, and the length of product dispensed may be varied with little difficulty simply by changing the length-determining rotary member of the mechanism. The length of sheet material dispensed is quite accurate as the measuring roller is provided with a large area for frictional contact and also serves as a roll-support roller. Further, the measuring dispenser is capable of being assembled for right or left hand operation with minimal modification.

In one respect, the invention comprises an apparatus with a support means for rotationally supporting a roll of sheet material to be dispensed, a rotary member which carries a projection and is rotationally driven an amount proportional to the length of sheet material withdrawn from the roll. A pivoted member includes an abutment surface movable into the path of the projection to stop rotation of the rotary member. Means are provided for moving the pivoted member from its projection-obstructing position to a second or non-obstructing position where the projection on the rotary member is capable of moving thereby. Also on the pivoted member is a reset surface which is positioned so that the projection moving toward the pivoted member arrives at the abutment surface before passing the reset surface. As the abutment surface is moved from the path of the projection on the rotary member, the reset surface is moved into said path. When the projection moves against the reset surface, the force so delivered to the pivoted member returns the pivoted member to its original projection-abutting position so as to stop the rotary member upon completion of a single 360° revolution.

The invention also involves the previously-discussed mechanism in combination with a support means for the roll of sheet material, such support means including a pair of spaced rollers underlying the roll of sheet material and being spaced apart a distance less than the diameter of the roll of sheet material so as to support the roll of sheet material for dispensation and to enable convenient placement and removal of the rolls of sheet material from the support means.

The invention also involves the aforementioned mechanism in combination with a replacement rotary member of different diameter than the original rotary member to enable a substitution for variation of the length of sheet material dispensed. Further inventive concepts contemplated within the invention are disclosed in the following description and embodied in the claims submitted herewith.

DESCRIPTION OF THE DRAWINGS

FIGS. 3–5 are diagramatic views showing a sequence of operation of the preferred mechanism. FIG. 3 shows in solid lines the apparatus at the commencement of a cycle of operation and in broken lines the mechanism during an early stage in its cycle of operation. FIG. 4 shows the resetting of the pivoted member to its initial position as a result of movement of the projection on the rotary member. FIG. 5 shows the conclusion of a cycle of operation at which dispensation is stopped.

FIGS. 6 and 7 illustrate the manner in which the length of material dispensed is changed by replacing the rotary member and shifting its axis to bring it into engagement with the drive means.

DESCRIPTION OF A PREFERRED EMBODIMENT

Figure 1:
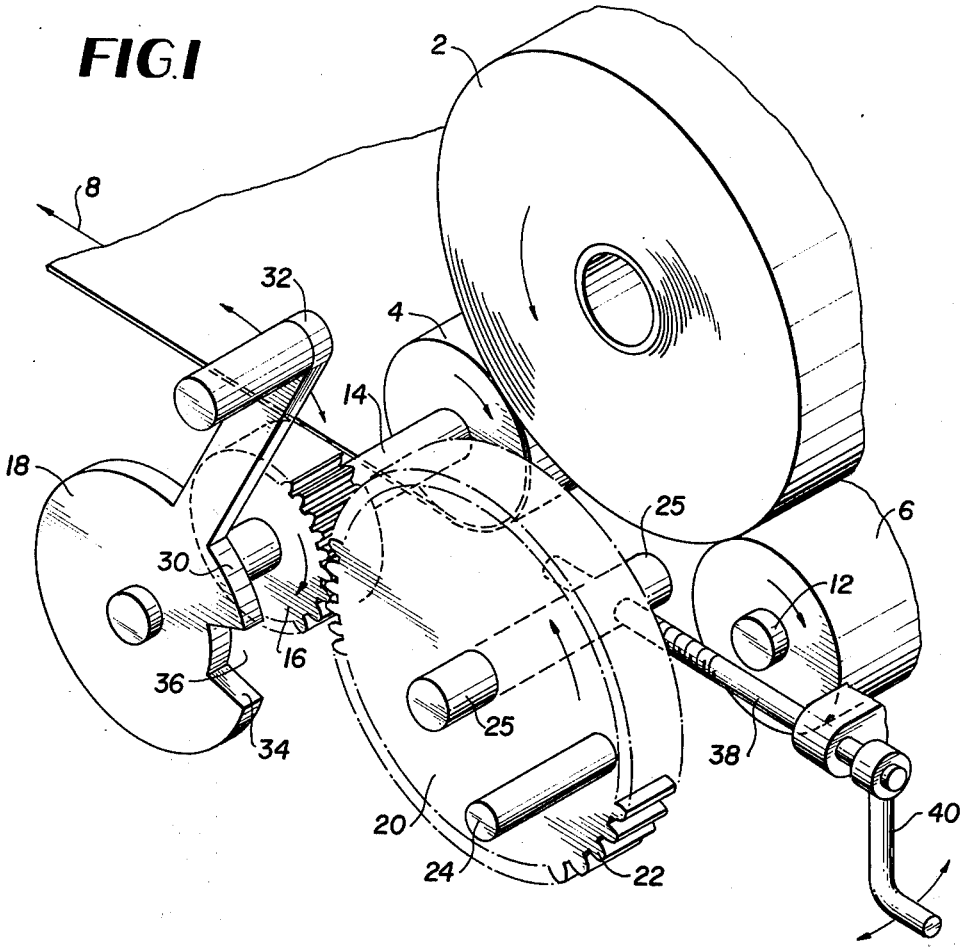
FIG. 1 is a diagramatic perspective view of one form of apparatus constructed according to the invention.
Figure 2:
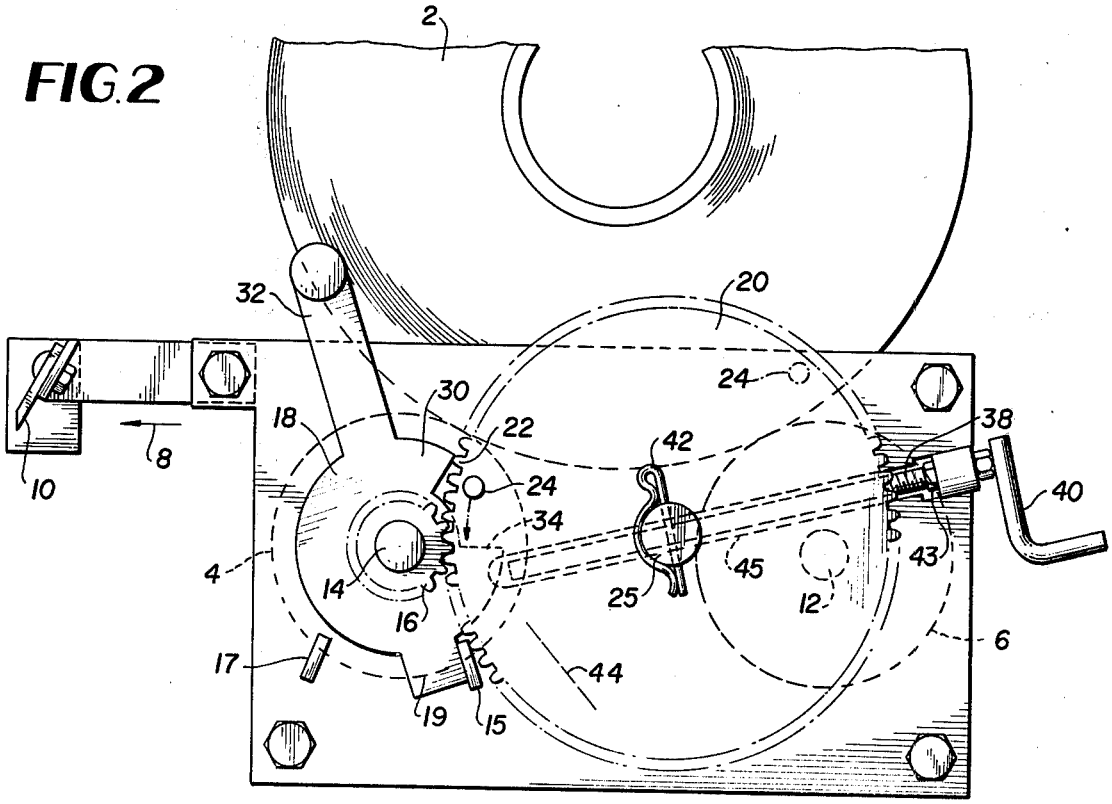
FIG. 2 is a side view of an apparatus substantially similar in principle and construction to that of FIG. 1, differing from FIG. 1 only with respect to the placement of the handle-operated pivoted member and the projection which engages against it.

FIGS. 1 and 2 show a roll 2 of sheet material supported on two spaced apart rollers 4 and 6 which are rotatable about fixed axes and spaced apart a distance less than the diameter of roll 2. Such a support means enables the roll 2 to be gravitationally supported on the rollers 4 and 6 and easily removed and replaced as there is no necessity for removal of a spindle passing through the center of roll 2.

The sheet material from roll 2 is threaded in a clockwise direction about the roller 4 and is pulled by an operator in the direction of the arrow 8 to a cutter blade, the latter being shown at 10 in FIG. 2.

The roll-supporting roller 6 is rotationally mounted on an axle 12, and the roller 4 is carried by and affixed to a rotational axle 14. In addition to supporting the roller 4 the axle 14 is keyed to a drive gear 16 for concurrent rotation. A rocker or pivoted member 18 rotates freely on the axle 14. The angular extent of such rotational movement is limited by stops 15 and 17 which lie on opposite sides of the extension 19 of pivoted member 14 as shown in FIG. 2. The clockwise limit of pivotal movement and hence the first position of member 18 is established by the stop 17, and the counterclockwise limit of movement is determined by the stop 15. It will be observed that the pivot axis of the member 18, the rotational axis of the drive gear 16 and the rotational axis of the roller 4 are mutually coincident. Member 18 is preferably on the inner side of the gear 16 as shown in FIG. 2, but is shown on the outer side thereof in FIG. 1 for illustrative purposes.

The extent to which sheet material may be withdrawn from the supply roll 2 is governed by a rotary member 20 which in this preferred embodiment is a gear having peripheral teeth 22 and a pin 24 which serves as a projection on the rotary gear 20. The gear 20 rotates about a rotational axis established by the non-rotatable stub shaft 25. The teeth 22 on gear 20 engage the teeth of drive gear 16 so that the gear 20 will be rotated in an amount which is proportional both to the peripheral movement of roller 4 and to the length of sheet material withdrawn from the roll 2.

The apparatus is constructed to enable the rotary gear 20 to make only a single revolution for each cycle of operation, thereby controlling the amount of sheet material which is dispensed during each cycle. The rocking pivoted member 18 limits the rotational movement of rotary gear 6 to a single revolution during each cycle. Specifically, the pivoted member 18 provides an abutment surface 30 which is movable into the path of the projection 24 on the rotary gear 20, the abutment surface then being manually removable from the path to enable the apparatus to perform another cycle of operation. As illustrated in FIG. 1, the rocking pivoted member 18 is in a first position where the abutment surface 30 is in the path of the projection 24 so that, when the projection 24 arrives at the pivoted member 18, it will strike the abutment surface 30, stop rotation of the gears 20 and 16, stop rotation of the shaft 14 and roller 4 thereby preventing dispensation of additional material. At this point, a precise measured amount of sheet material has been dispensed and may be torn on the cutter bar 10.

To explain further, the pivoted member 18 is movable back-and-forth between a first projection-obstructing position shown in FIG. 1 and a second non-obstructing position shown in FIG. 2. When member 18 is in the first position, the extension 19 contacts the stop 17 and the abutment surface 30 is located in the path of projection 24. The abutment surface 30 is located so as not to move the pivoted member 18 to its non-obstructing position when contacted by the projection. In the second position shown in FIG. 2, the extension 19 contacts the stop 15. The abutment surface 30 is withdrawn from the path of projection 24 to permit the projection 24 to pass thereby during rotation of the rotary gear 20.

A handle 32 extends upwardly from the pivoted member 18 so that an operator may move the pivoted member 18 from its projecting-obstruction position to the non-obstructing position shown in FIG. 2. During such movement, the handle 32 passes directly over the pivot axis of member 18, moving over-center to cause the member 18 to remain gravitationally in its non-obstructing position.

The pivoted member 18 also has a surface 34 termed a "reset surface" herein since its purpose is to return the abutment surface 30 from its non-obstructing position to its projection-obstructing position. This reset surface 34 is one face of a notch 36 formed in the member 18. When the member 18 is in its non-obstructing position as shown in FIG. 2, it will be observed that the reset surface 34 is in the path of projection 24, located to move the member 18 to its first projection-obstructing position when the projection 24 moves against the reset surface 34. When the pivoted member 18 arrives at the projection-obstructing position of FIG. 1, the reset surface 34 has moved from the path of the projection 24. The handle 32 has moved over-center to maintain the pivoted member 18 in position.

The operational sequence of the apparatus is illustrated in FIGS. 3, 4 and 5. At the outset of a cycle of operation, the apparatus is in the position shown in solid lines in FIG. 3, the projection 34 resting against the abutment surface 30 on the pivoted rocker member 18. The operator commences a cycle of operation by moving handle 32 over-center to the broken line position shown in FIG. 3, thus withdrawing the abutment surface 30 from the path of projection 24. The operator then pulls the sheet of material being dispensed, rotating the material roll 2 and the supporting roller 6, rotating gears 16 and 20 and moving the projection 24 in its circular path. At an early stage of the movement of the projection 24 in its circular path, it strikes the reset surface 34 which then lies in its path. Movement of the projection 24 against the reset surface 34 produces clockwise pivotal movement of the member 16, the handle 34 moving over-center of the pivotal axis to the position shown in FIG. 4. This movement also returns the abutment surface 30 into the path of the projection 24. When the projection 24 arrives again at the pivoted member as shown in FIG. 5, it strikes the abutment surface 30, stopping dispensation after a precise measured amount of material has been dispensed to be torn from the apparatus.

There are instances when it is desirable to change the length of material dispensed. To enable the present apparatus to be modified to dispense a different length of material, the rotary gear 20 may be replaced by another rotary gear of similar construction but different diameter.

Removal of the rotary gear 20 is facilitated by the easily removed resilient retainer pin 42, shown in FIG. 2. The stub shaft 25 for gear 20 is laterally movable on a stationary elongated track 45. Shaft 25 has a transverse threaded bore which receives a threaded shaft 38. The shaft 38 is rotatable about a fixed axis by a crank 40 attached to one end thereof. A lock nut 43 prevents rotational and axial movement of shaft 38 during normal operation.

To effect gear replacement, the retainer pin 42 is removed and rotary gear 20 pulled from the stub shaft 25 as shown in FIG. 6. A smaller gear **20*a* with a projection 24*a* is placed on the shaft 25 as shown in FIG. 6 and the resilient pin 42 is replaced. Lock nut 43 is loosened and the crank 40 is turned to move the axis of the stub shaft 25 toward the drive gear until the gear teeth mesh as shown in FIG. 7. After tightening the lock nut 43, the device is ready for operation and will dispense precisely measured lengths of material, shorter than the lengths dispensed when operating with the rotary gear 20**.

If desired, the apparatus may be constructed to cut two narrow sheets of material at a time by placing a taut wire at the position 44 so that wire passing between the nip of roll 2 and roller 4 toward the cutter bar 10 will be slit longitudinally as it advances. A substantial number of other modifications and variations to the system will be appreciated by those familiar with this art. Therefore, it is emphasized that the invention is not limited only to the disclosed embodiment but is encompassing of other variations, modifications and improvements thereto which fall within the spirit of the following claims.

I claim:

1. Apparatus for dispensing uniform lengths of sheet material from a roll, comprising, support means for rotationally supporting a roll of sheet material for dispensation, a rotary member, drive means responsive to rotation of said roll of sheet material for rotating said rotary member about a rotational axis in an amount proportional to the length of sheet material withdrawn from said roll of sheet material, a projection affixed to and movable with said rotary member in a circular path upon rotation of said rotary member, a pivoted member movable about a pivot axis from a first to a second position, an abutment surface and a reset surface affixed to said pivoted member, said abutment surface and said reset surface being positioned so that said projection while moving along said path toward said pivoted member arrives at said abutment surface before passing said reset surface, said abutment surface being located at an obstructing position in the path of said projection when the pivoted member is in its first position and being withdrawn from the path of said projection when the pivoted member in its second position, said abutment surface being located so as not to move said pivoted member to its second position when said projection moves against said abutment surface, said reset surface being spaced from the path of said projection when the pivoted member is in its first position and being located in the path of said projection when the pivoted member is in its second position, means for moving said pivoted member about said pivot axis from said first position to said second position to withdraw said abutment surface from the path of said projection and to position said reset surface in the path of said projection, said reset surface being located to move said pivoted member and return said pivoted member to its first position when the projection moves thereagainst, whereby said abutment surface is returned to its obstructing position.

2. The apparatus of claim 1 wherein the support means for supporting a roll of sheet material include a pair of spaced rollers underlying the roll of sheet material, said rollers being spaced apart a distance which is less than the diameter of the roll of sheet material so as to support said roll of sheet material for dispensation and to enable convenient placement and removal of rolls of sheet material from the support means.

3. The apparatus of claim 2 wherein the drive means includes a drive gear connected to and rotatable with one of said rollers.

4. The apparatus of claim 3 wherein said rotary member has means for engaging said drive gear, and said drive gear is engaged with said rotary member.

5. The apparatus of claim 3 wherein said drive gear is supported for rotation about an axis coincident with said pivot axis.

6. The apparatus of claim 2 wherein the means for moving said pivoted member is a manually-operable handle connected to said pivoted member.

7. The apparatus of claim 6 wherein said handle moves directly over the pivot axis when the pivoted member moves from said first position to said second position, whereby said handle moves over-center to remain gravitationally in either said first position or said second position.

8. The apparatus of claim 2 wherein the drive means includes a drive gear rotatable about a drive gear axis and engaged with said rotary member, said rotary member being removable from said apparatus, a substitute rotary member replaceable for and of different diameter than the aforesaid rotary member to change the extent of rotation of said rotary member, and means for changing the distance between said rotational axis and said drive gear axis to bring the substitute rotary member into engagement with said drive gear.

9. The apparatus of claim 1 wherein the means for moving said pivoted member is a manually-operable handle connected to said pivoted member.

10. The apparatus of claim 9 wherein said handle moves directly over the pivot axis when the pivoted member moves from said first position to said second position, whereby said handle moves over-center to remain gravitationally in either said first position or said second position.

11. The apparatus of claim 10 wherein the drive means includes a drive gear rotatable about an axis coincident with said pivot axis.

12. The apparatus of claim 1 wherein the drive means includes a drive gear rotatable about a drive gear axis and engaged with said rotary member, said rotary member being removable from said apparatus, a substitute rotary member replaceable for and of different diameter than the aforesaid rotary member to change the extent of rotation of said rotary member, and means for changing the distance between said rotational axis and said drive gear axis to bring the substitute rotary member into engagement with said drive gear.

* * * * *